US006869303B1

(12) United States Patent
Ma

(10) Patent No.: US 6,869,303 B1
(45) Date of Patent: Mar. 22, 2005

(54) LAND GRID ARRAY CONNECTOR ASSEMBLY WITH COMPACT CAM DRIVER

(75) Inventor: Hao-Yun Ma, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/708,615

(22) Filed: Mar. 15, 2004

(51) Int. Cl.[7] ..... H01R 13/62
(52) U.S. Cl. ..... 439/331
(58) Field of Search ..... 439/331, 73

(56) References Cited

U.S. PATENT DOCUMENTS 6,045,370 A * 4/2000 Treibergs et al. ..... 439/73
6,400,565 B1 * 6/2002 Shabbir et al. ..... 361/687

* cited by examiner

*Primary Examiner*—Phuong Dinh
(74) *Attorney, Agent, or Firm*—Wei Te Chung

(57) ABSTRACT

An electrical connector assembly (1) for electrically connecting an electronic package with a circuit substrate. The connector assembly includes a socket and a fastening device surrounding the socket. The fastening device includes a frame (2), a metal clip (3) pivotably mounted to a first end of the frame, and a cam actuator (4) pivotably mounted to a second end of the frame. The clip includes a changeable post (3211) at a free end (32) thereof. The cam actuator includes a cam (41) defining a spiral groove (413) receiving the post and a driver (42) assembled to the cam. When the cam is driven, it drives the post downwardly, and simultaneously the clip moves slightly toward the second end of the frame. In addition, because the post can be changed, user can avoid increased complexity and cost in repairing the LGA connector assembly.

4 Claims, 6 Drawing Sheets

LAND GRID ARRAY CONNECTOR ASSEMBLY WITH COMPACT CAM DRIVER

BACKGROUND OF INVENTION

1. Field of the Invention

The present invention relates to an electrical connector assembly for electrically connecting an electronic package such as a central processing unit (CPU) with a circuit substrate such as a printed circuit board (PCB), and particularly to a land grid array connector assembly having a fastening device for securing the CPU therein.

2. Description of Related Art

FIGS. 6 and 7 show a conventional land grid array (LGA) connector assembly 6 fixed on a printed circuit board (PCB) 9. The LGA connector assembly 6 comprises a fastening device 60, and a socket 61 received in the fastening device 60. The fastening device 60 comprises a generally rectangular frame 63, and a lever 62 and a clip 64 respectively mounted to opposite ends of the frame 63. The frame 63 defines a pair of locating slots 66 at one end thereof, and a pair of guiding grooves 65 at an opposite end thereof. Each guiding groove 65 is bounded by a first wall 651 and an opposite second wall 652. The lever 62 has a pair of locating portions 623 pivotally received in the locating slots 66 of the frame 63, an offset driving portion 621 between the locating portions 623, and a handle portion 622 bent perpendicularly from one of the locating portions 623. The clip 64 has a pair of securing portions 641 movably received in the guiding grooves 65 of the frame 63, and a driving hook 644 formed at a free end thereof.

In use, the clip 64 is firstly oriented perpendicular to the frame 63, with the securing portions 641 movably disposed in the guiding grooves 65 close to the first walls 651. A central processing unit (CPU) 7 is attached on the socket 61, and a copper plate 8 which functions as a heat dissipation device is attached on the CPU 7. Then the clip 64 is rotated down to a horizontal position, with a pair of pressing arms and a pair of pressing pads of the clip 64 abutting the copper plate 8. The handle portion 622 of the lever 62 is rotated down, and the driving portion 621 of the lever 62 engages in the driving hook 644 of the clip 64. The driving portion 621 drives the driving hook 644 down until the clip 64 is in a final pressing position firmly pressing the copper plate 8 on the CPU 7. However, the handle portion 622 of the lever 62 occupies an extra: space outside the frame 63 over the PCB 9. In contemporary miniaturized electronic devices such as notebook computers, this is increasingly regarded as efficient use of the valuable "real estate" of the PCB 9, and is becoming more and more undesirable and even not feasible.

The conventional LGA connector assembly 6 inherits another disadvantage. When the driving hook 644 is unduly pressed by the driving portion 621 and thus damaged, the whole clip 64 need to be changed. This results in the increased complexity and cost in repairing the LGA connector assembly 6.

In view of the above, a new LGA connector assembly that overcomes the above-mentioned disadvantages is desired.

SUMMARY OF INVENTION

Accordingly, an object of the present invention is to provide an electrical connector assembly such as a land grid array (LGA) connector assembly for electrically connecting an electronic package such as a central processing unit (CPU) with a circuit substrate such as a printed circuit board (PCB), whereby the LGA connector assembly has a fastening device for securely and reliably locating the CPU in the LGA connector assembly while the LGA connector occupies minimal space of the PCB.

Still another object of the present invention is to provide a repairable clip for the electrical connector assembly.

To achieve the above-mentioned objects, an LGA connector assembly in accordance with a preferred embodiment of the present invention is for electrically connecting a CPU with a PCB. The LGA connector assembly comprises a socket and a fastening device surrounding the socket. The fastening device comprises a frame, a metal clip pivotably mounted to a first end of the frame, and a cam actuator pivotably mounted to a second end of the frame. The clip incorporates a changeable post at a free end thereof. The cam actuator comprises a cam defining a spiral groove receiving the post and a driver assembled to the cam. When the cam is driven, it drives the post downwardly, and simultaneously the clip moves slightly toward the second end of the frame. In addition, the driver at all times remains substantially within the confines of the main body of the frame. Thus, the LGA connector assembly efficient uses the estate of the PCB. In addition, because the post can be changed, user can avoid increased complexity and cost in repairing the LGA connector assembly 6.

Other objects, advantages and novel features of the invention will become more apparent from the following detailed description when taken in conjunction with the accompanying drawings, in which:

DETAILED DESCRIPTION

Reference will now be made to the drawings to describe the present invention in detail.

Figure 1:
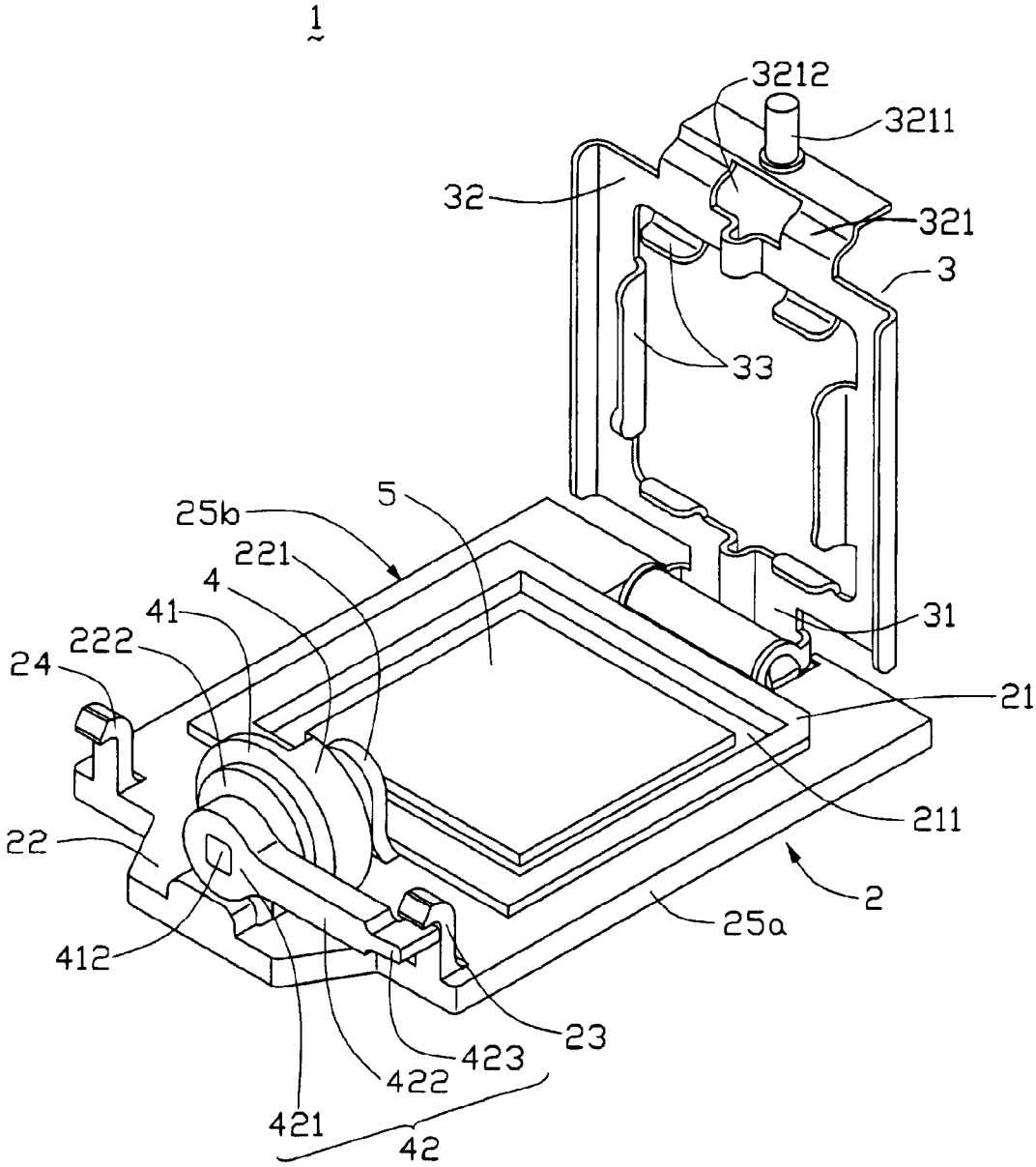
FIG. 1 is a perspective view of a land grid array (LGA) connector assembly in accordance with the preferred embodiment of the present invention, showing a metal clip of the connector assembly at a vertical open position.
Figure 2:
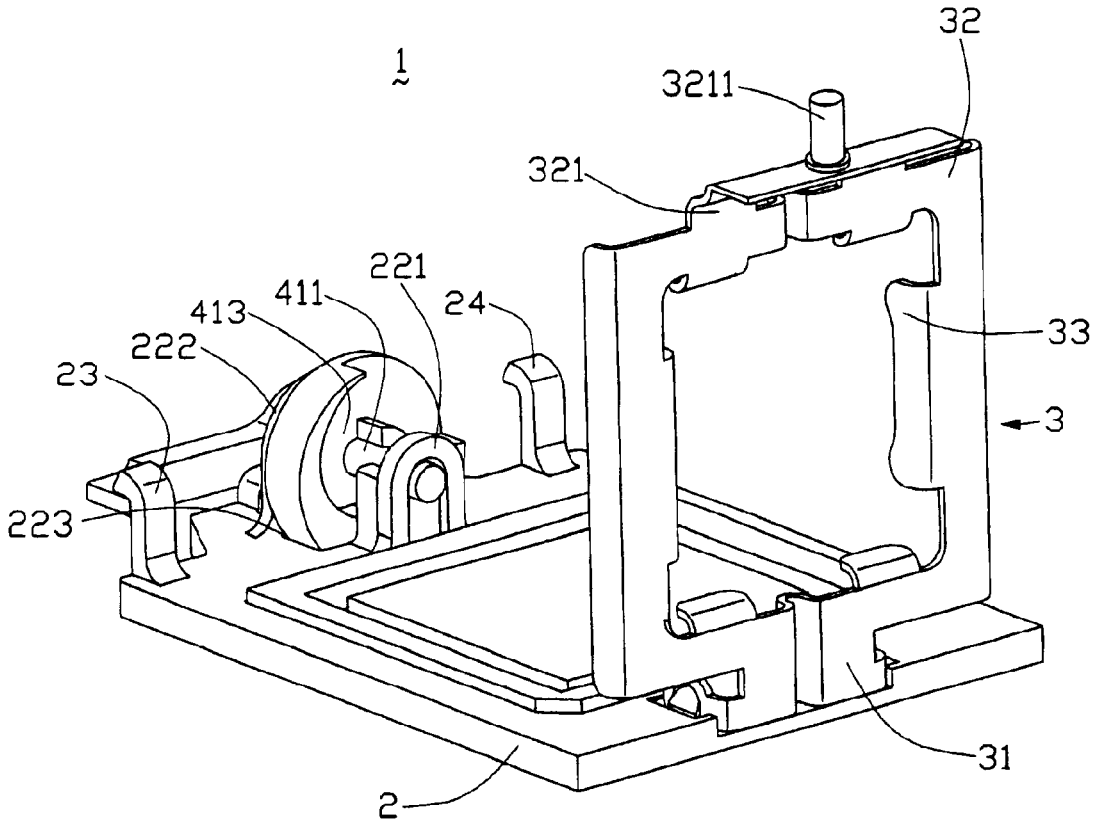
FIG. 2 is similar to FIG. 1, but viewed from another aspect.

Referring to FIGS. 1 and 2, a land grid array (LGA) connector assembly 1 in accordance with the preferred embodiment of the present invention is for electrically connecting a central processing unit (CPU) (not visible) with a printed circuit board (PCB) (not shown). The LGA connector assembly 1 comprises a socket (not visible), and a fastening device surrounding the socket. The socket has a plurality of LGA contacts provided therein. The fastening device comprises an insulative frame 2 having two opposite lateral edges 25*a*, 25*b* interconnected by opposite first and second ends, a metal clip 3 rototably mounted to the first end of the frame 2, and a cam actuator 4 rotatably mounted to the second end of the frame 2.

The frame 2 comprises a low-profile inner peripheral wall 21 on a top thereof. The peripheral wall 21 cooperates with a main body of the frame 2 to define a receiving recess 211 therebetween. The socket is arranged at a bottom of the receiving recess 211. The CPU is attached on the socket, and a copper plate 5 is attached on the CPU. Thus the CPU and the copper plate 5 are received in the receiving recess 211.

The second end of the frame 2 has an extending portion 22 adjoining a middle thereof. A hook-shaped first lock 23 and a hook-shaped second lock 24 extend upwardly from respective opposite sides of the second end of the frame 2. A first supporting rack 221 is upwardly formed on the second end of the frame 2. A second supporting rack 222 is upwardly formed on the extending portion 22 of the frame 2, and is parallel to the first supporting rack 221. A receiving slot 223 is defined in the second end of the frame 2, between the first and second supporting racks 221, 222.

The clip 3 comprises a first end 31 pivotably mounted to the first end of the frame 2, an opposite second end 32 having an outer extending portion 321, and two spaced and parallel beams (not labeled) respectively interconnecting the first and second ends 31, 32. A plurality of symmetrically arranged pressing pads 33 depends perpendicularly from inner edges of the first and second ends 31, 32 and from the beams. A post 3211 is formed at a free end of the extending portion 321. A gap 3212 is defined in the extending portion 321 between the post 3211 and the second end 32.

The cam actuator 4 comprises a cam 41, and a driver 42 for driving the cam 41. The cam 41 is partially received in the receiving slot 223 of the frame 2. A supporting pole sequentially passes through the first supporting rack 221, the cam 41 and the second supporting rack 222, thereby rotatably positioning the cam 41 on the frame 2. The supporting pole comprises a first supporting portion 411 supported on the first supporting rack 221, and a second supporting portion 412 supported on the second supporting rack 222. The first supporting portion 411 is cylindrical, and the second supporting portion 412 has a square cross-section. A spiral groove 413 is defined in the cam 41. The spiral groove 413 spans between a circumferential surface of the cam 41 and a center of the cam 41, and faces the clip 3. The driver 42 comprises a driving portion 421 fixed on the second supporting portion 412, a handle portion 423 for facilitating manual operation, and a connecting portion 422 interconnecting the driving portion 421 and the handle portion 423.

Figure 3:
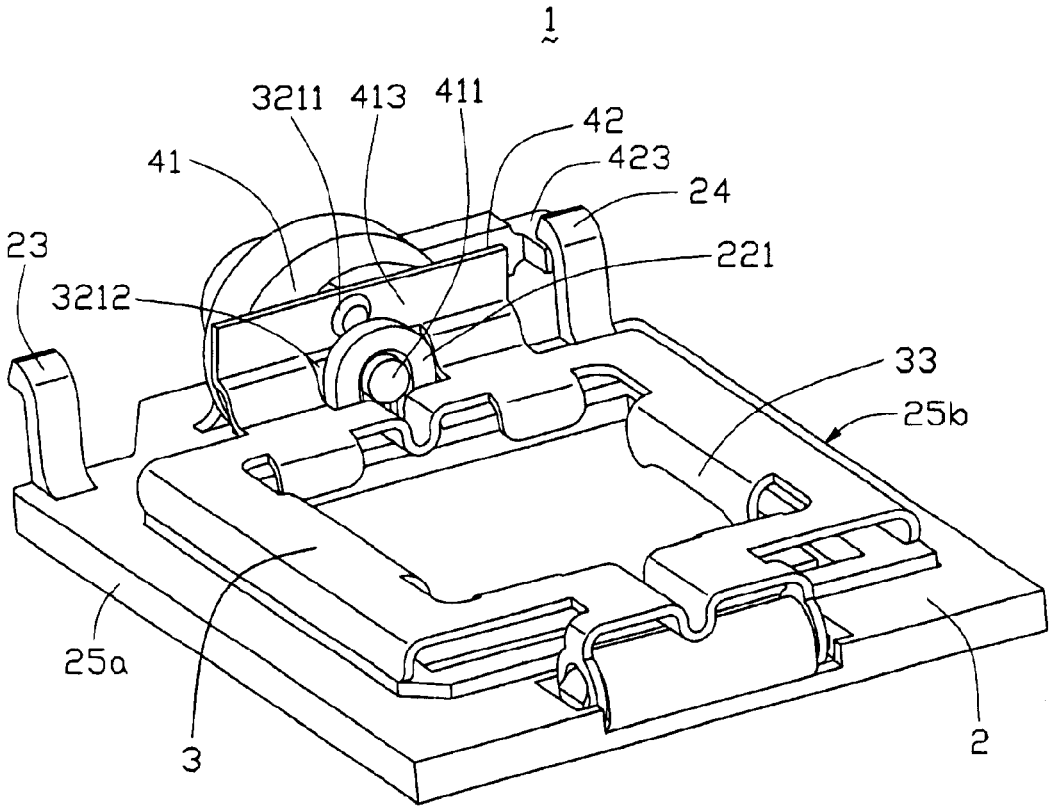
FIG. 3 is similar to FIG. 2, but showing the clip at the horizontal closed position.
Figure 4:
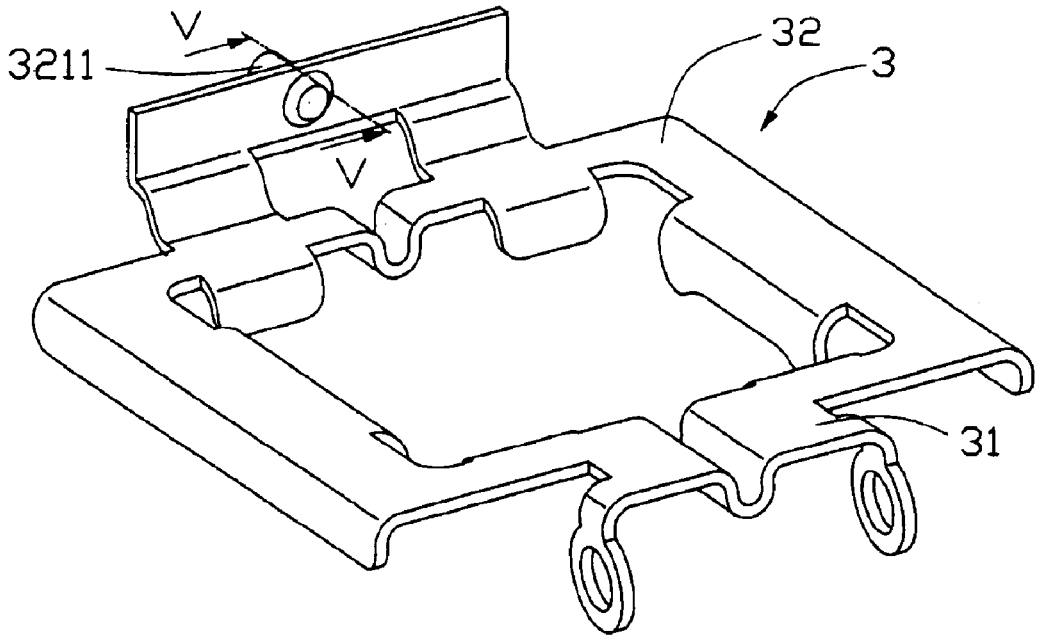
FIG. 4 is a perspective view of the metal clip of FIG. 1.

Referring FIG. 3 in conjunction with FIGS. 1 and 2, in use, the clip 3 is oriented perpendicular to the frame 2 in an open position. This enables the CPU and the copper plate 5 to be inserted into the receiving recess 211 of the frame 2 and then attached on the socket. The cam actuator 4 is oriented at an open position, in which the handle portion 423 of the driver 42 is locked by the first lock 23, and an outmost portion of the spiral groove 413 of the cam 41 is at a highest position. The clip 3 is rotated down to a substantially horizontal closed position until the pressing pads 33 abut the copper plate 5. At this position, the post 3211 of the clip 3 is received in the spiral groove 413 of the cam 41, and part of the first supporting rack 221 of the frame 2 is received through the gap 3212 of the clip 3. Thus the clip 3 is loosely engaged with the cam 41 of the cam actuator 4. Movement of the post 3211 of the clip 3 toward the extending portion 22 of the frame 2 is limited by a wall of the cam 41 at the spiral groove 413. Then the driver 42 is rotated up and away from the first lock 23. The driver 42 drives the cam 41 to rotate about a central axis of the cam 41. The cam 41 drives the post 3211 of the clip 3 downwardly, and at the same time the clip 3 moves slightly toward the extending portion 22 of the frame 2 relative to the copper plate 5. However, excessive such movement in this direction is blocked by the wall of the cam 41 at the spiral groove 413. The handle portion 423 of the driver 42 continues to be rotated until it is locked by the second lock 24. The clip 3 is then at a final pressing position, in which the pressing pads 33 of the clip 3 firmly press down on the copper plate 5. When rotating the handle portion 423 of the driver 42, the driver 42 at all times remains substantially within the confines of the main body of the frame 2 between the two opposite edges 25*a*, 25*b* thereof. Thus, the LGA connector assembly 1 makes efficient use of the "real estate" of the PCB.

Figure 5A:
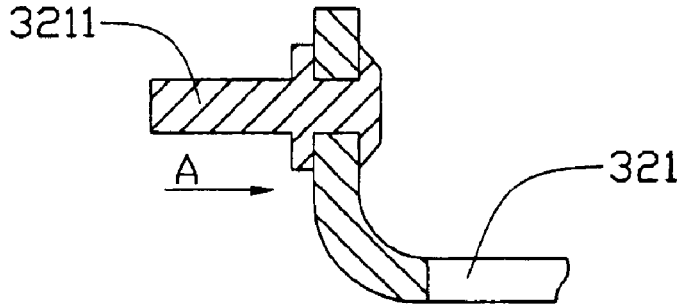
FIGS. 5A–5C are cross-sectional views along the line IV—IV of FIG. 3, showing different embodiments of the metal clip.
Figure 5B:
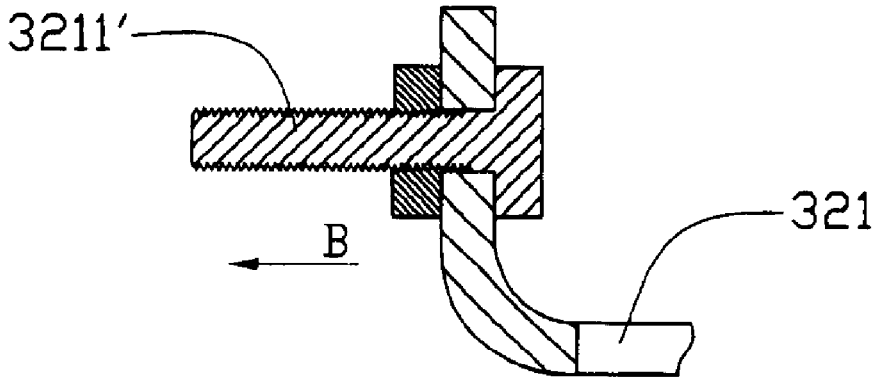
Figure 5C:
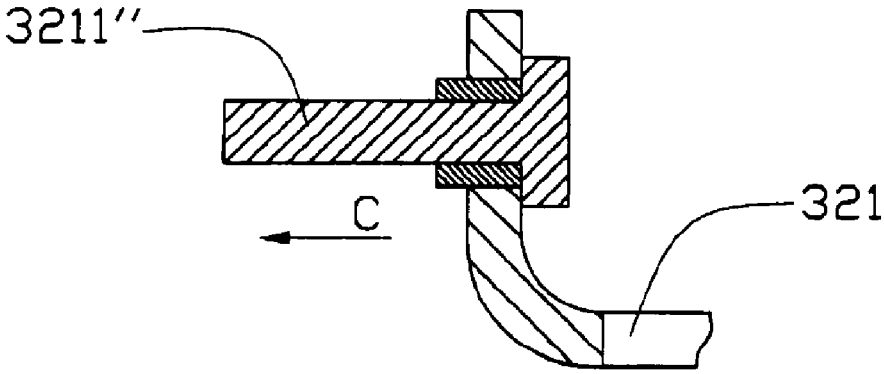
Figure 6:
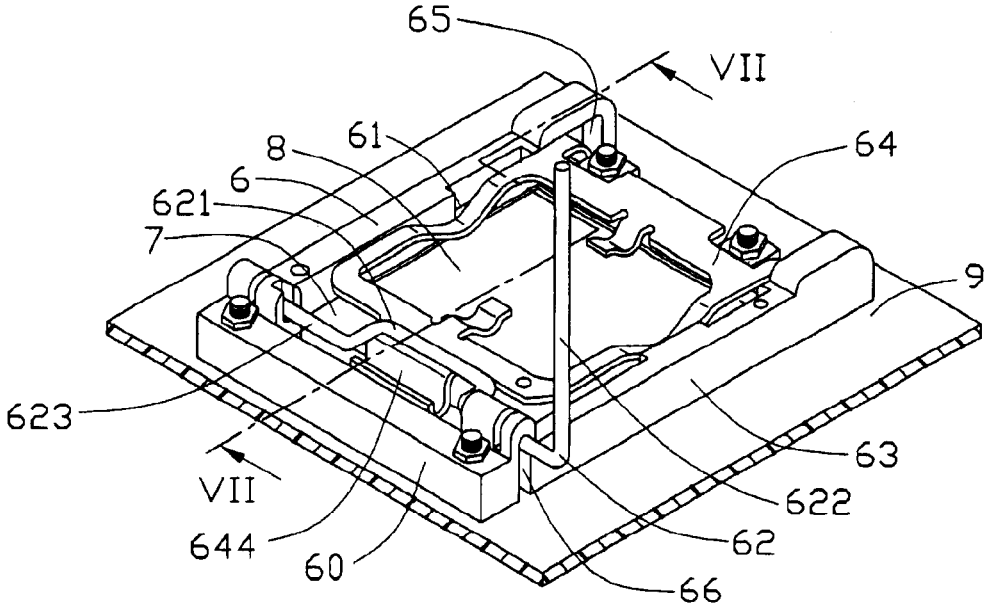
FIG. 6 (PRIOR ART)
FIG. 6 is an isometric view of a conventional LGA connector assembly mounted on a PCB.
Figure 7:
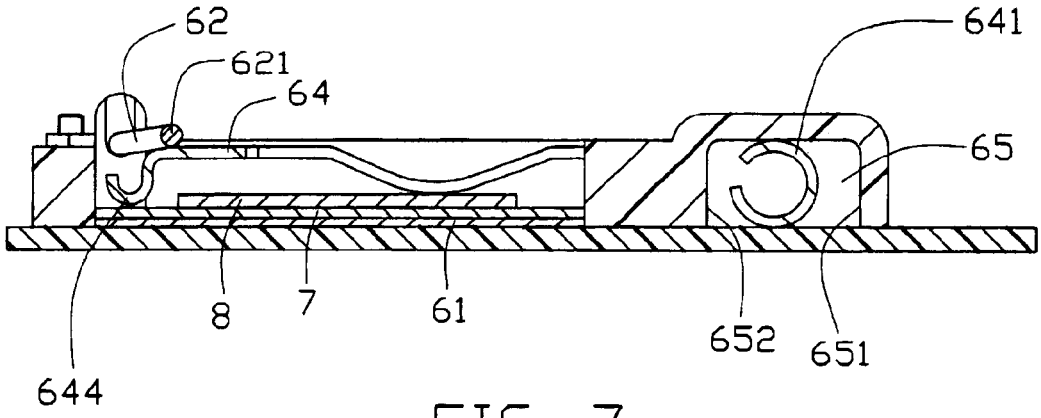
FIG. 7 (PRIOR ART)
FIG. 7 is a cross-sectional view taken along line VII—VII of FIG. 6.

Referring FIGS. 4 and 5A–5C, the post 3211 of the clip 3 can be riveted, screwed, or press-fitted onto the extending portion 321. When the post 3211 is overly actuated and thus damaged, the post 3211 can be changed without substituting the whole clip 3. Referring particularly to FIG. 5A, after the post 3211 is inserted into the extending portion 321 along the direction indicated by arrow A, end of the post 3211 can be riveted to fix the post 3211 onto the extending portion 321. Referring particularly to FIG. 5B, the post 3211' can be lathed as screw-shaped. When the post 3211' is inserted into the extending portion 321 along the direction indicated by arrow B, a nut (not labeled) can cooperate with the screw-shaped post 3211' and fasten the post 3211' onto the extending portion 321. Referring particularly to FIG. 5C, after the post 3211" is inserted into the extending portion 321 along the direction indicated by arrow C, a sleeve (not labeled) can be squeeze into the gap between the post 3211" and the extending portion 321 thereby fastening the post 3211" onto the extending portion 321.

While preferred embodiments in accordance with the present invention have been shown and described, equivalent modifications and changes known to persons skilled in the art according to the spirit of the present invention are considered within the scope of the present invention as defined in the appended claims.

What is claimed is:

1. An electrical connector assembly comprising:

an insulative frame comprising two opposite edges and opposite first and second ends between the edges;

a clip pivotably mounted to the first end of the frame, the clip comprising an extending portion and a post removably attached at the extending portion; and an actuator pivotably mounted to the second end of the frame, the actuator comprising a driver and urging means for urging the clip;

wherein when pivoting the driver, the driver at all times remains substantially within the confines of the frame; wherein the urging means of the actuator is a cam, a first supporting rack and a second supporting rack are arranged on the second end of the frame, and the second end of the frame defines a slot between the first and the second supporting racks; wherein the supporting pole sequentially passes through the first and the second supporting rack, the cam and the second supporting rack, and the cam is partially received in the slot of the frame, thereby pivotally positioning the cam on the frame; wherein the supporting pole comprises a first supporting portion and a second supporting portion respectively at the first and the second supporting racks, and the driver is fixed on the second supporting portion; wherein the driver comprises a driving portion fixed on the second supporting portion of the supporting pole, a handle portion and a connecting portion interconnecting the driving portion and the handle portion.

2. The electrical connector assembly as claimed in claim 1, wherein the post is riveted at the extending portion of the clip.

3. The electrical connector assembly as claimed in claim 1, wherein the post is screwed at the extending portion of the clip.

4. The electrical connector assembly as claimed in claim 1, wherein the post is press-fitted at the extending portion of clip.

* * * * *